US011635178B2

(12) United States Patent
Lin et al.

(10) Patent No.: US 11,635,178 B2
(45) Date of Patent: Apr. 25, 2023

(54) FLUSH-MOUNT LED HOUSING

(71) Applicant: Tivoli, Inc., Irvine, CA (US)

(72) Inventors: Lien-Chung Lin, Brea, CA (US); Bey Shing Jang, Santa Ana, CA (US)

(73) Assignee: Tivoli, Inc., Irvine, CA (US)

( * ) Notice: Subject to any disclaimer, the term of this patent is extended or adjusted under 35 U.S.C. 154(b) by 0 days.

(21) Appl. No.: 17/569,024

(22) Filed: Jan. 5, 2022

(65) Prior Publication Data

US 2022/0333747 A1 Oct. 20, 2022

Related U.S. Application Data

(63) Continuation-in-part of application No. 17/534,975, filed on Nov. 24, 2021.

(Continued)

(51) Int. Cl.
*F21S 4/10* (2016.01)
*F21V 21/005* (2006.01)

(Continued)

(52) U.S. Cl.
CPC ..... *F21S 4/10* (2016.01); *F21V 21/005* (2013.01); *F21V 21/047* (2013.01); *F21W 2121/00* (2013.01); *F21Y 2115/10* (2016.08)

(58) Field of Classification Search
CPC ..... F21S 4/10; F21V 21/005; F21V 21/047
See application file for complete search history.

(56) References Cited

U.S. PATENT DOCUMENTS

2002/0176257 A1 11/2002 Cummings et al.
2011/0210677 A1* 9/2011 Hering ..... H01R 31/06 362/249.06

(Continued)

FOREIGN PATENT DOCUMENTS

CN 30482718 S 9/2018
EP 2311025 B1 9/2015

(Continued)

OTHER PUBLICATIONS

Cablematric—Description and Specification for Garland Lamp Holder E27 for Rectangular Wire 6X10 MM. 2 pages. Accessed on Feb. 25, 2022. Retrieved from https://cablematric.com/en/products/garland-lamp-holder-e27-for-rectangular-wire-6x10-mm-NT049.

(Continued)

*Primary Examiner* — Karabi Guharay
(74) *Attorney, Agent, or Firm* — Kilpatrick, Townsend and Stockton, LLP

(57) ABSTRACT

A light fixture comprising a housing with a first end and a second end opposite the first end is installed by removing a cap removably coupled with the second end of the housing and mounting the housing to a surface such that the housing is adjacent the surface. Cavities formed by walls of first and second flanges coupled with the housing at the second end are configured to receive fasteners to secure the housing to a surface. Light from a light source coupled with the housing is configured to be emitted from the housing at the first end of the housing. The light fixture is hung from a cable by passing a cord through an opening formed by walls of the cap and around the cable while the cap is removably coupled with the housing.

20 Claims, 7 Drawing Sheets

Related U.S. Application Data

(60) Provisional application No. 63/175,812, filed on Apr. 16, 2021.

(51) Int. Cl.

| | |
|---|---|
| ***F21V 21/04*** | (2006.01) |
| *F21W 121/00* | (2006.01) |
| *F21Y 115/10* | (2016.01) |

(56) References Cited

U.S. PATENT DOCUMENTS

| | | | | |
|---|---|---|---|---|
| 2019/0341718 | A1* | 11/2019 | Yu | F21V 21/096 |
| 2021/0153315 | A1 | 5/2021 | Yu | |
| 2021/0156530 | A1 | 5/2021 | Huang | |

FOREIGN PATENT DOCUMENTS

| | | | |
|---|---|---|---|
| KR | 20170034307 | A | 3/2017 |
| WO | 2019090810 | A1 | 5/2019 |

OTHER PUBLICATIONS

Builders SA—Create Your Own Rope Lights—DIY. 2 pages. Accessed on Feb. 25, 2022. Retrieved from https://sv-se.facebook.com/BuildersSA/videos/255707631802790/?video_source=permalink.

Product Description: Wireless RGBW 4 Channel LED Controller with Channel Pairing, aspect LED, a Wilson Tool Company, accessed on Apr. 21, 2022, retrieved from https://www.aspectled.com/collections/led-controllers/products/wireless-rgbw-4-channel-led-controller-channel-pairing?gclid=Cj0KCQiAhP2BBhDdARIsAJEzXIEEQB1WyBFteLqsFiAkdQN20FqW2fl-dKebk1pWLFZZSa3G9FIULUMaAolrEALw_wcB 3 pages.

* cited by examiner

FLUSH-MOUNT LED HOUSING

CROSS-REFERENCES TO RELATED APPLICATIONS

This application claims priority to U.S. Provisional Application No. 63/175,812, filed on Apr. 16, 2021, entitled "THREE CHANNEL LED CONTROL FOR COLOR AND WHITE LIGHT PERFORMANCE IN LIGHTING STRANDS," which is incorporated by reference for all purposes. This application is a continuation-in-part of U.S. application Ser. No. 17/534,975, filed on Nov. 24, 2021, which claims priority to U.S. Provisional Application No. 63/175,812, filed on Apr. 16, 2021, the disclosures of which are incorporated by reference for all purposes.

BACKGROUND

This disclosure generally relates to lighting, and without limitation to outdoor lighting. Light strands, including string lights, fairy lights, and holiday lights (e.g., Christmas tree lights), can be used for lighting or decoration. Light strands generally contain a plurality of electric lights equally spaced on cable, wire, or string. String lights often comprise a transparent bulb hanging from a cable (e.g., used to illuminate an area below them). Fairy lights are often smaller and in closer proximity than lights on a string light. Lights on a light strand can be the same or different colors.

SUMMARY

This disclosure relates to light strands. In some embodiments, a housing of a light in a light strand has a removable cap. The removable cap can be used to hang the light, or removed so the light can be flush mounted to a surface. In some embodiments, an apparatus is described. The apparatus may comprise a housing having a first end and a second end opposite the first end. The apparatus may further comprise a light source coupled with the housing, wherein light from the light source is configured to be emitted from the housing at the first end of the housing. The apparatus may further comprise a cap configured to be removeably coupled with the second end of the housing. The cap may comprise one or more walls that form an opening and be configured to remain fixed with respect to the housing while coupled with the housing. The apparatus may further comprise a first flange coupled with the housing at the second end of the housing. The first flange may comprise one or more walls that form a first cavity. The first cavity may be in the first flange. The apparatus may further comprise a second flange coupled with the housing at the second end of the housing. The second flange may comprise one or more walls that form a second cavity. The second cavity may be in the second flange.

In some embodiments, the second end of the housing comprises a first cylindrical sidewall that forms a recess in the housing configured to receive the cap while the cap is removeably coupled with the housing. The first cylindrical sidewall may comprise a first helical ridge. The cap may further comprise a cylindrical base. The cylindrical base may comprise a second cylindrical sidewall configured to fit within the recess in the housing such that the second cylindrical sidewall is completely within the first cylindrical sidewall. The second cylindrical sidewall may comprise a second helical ridge configured to mate with the first helical ridge. In some embodiments, the cap is further configured such that the opening is in a predefined orientation while the cap is removeably coupled with the second end of the housing.

In some embodiments, the housing may further comprise a first wire protector configured to restrict a first range of motion of a first cable containing a first wire coupled with the light source. The first wire protector may be coupled with the housing on an outer wall of the housing. The housing may further comprise a second wire protector configured to restrict a second range of motion of a second cable containing a second wire coupled with the light source. The second wire protector may be coupled with the housing and positioned opposite the first wire protector. In some embodiments, a wire axis is defined as a straight line from the first wire protector to the second wire protector. In some embodiments, the cap may be further configured so that the opening is oriented parallel or perpendicular to the wire axis while the cap is removeably coupled with the housing.

In some embodiments, the first flange is coupled with the housing between the first wire protector and the second wire protector. Additionally, or alternatively, the second flange may be coupled with the housing between the first wire protector and the second wire protector. In some embodiments, the second flange is coupled with the housing opposite the first flange. In some embodiments, a straight line from the first flange to the second flange is perpendicular to the wire axis. In some embodiments, the first cavity and the second cavity are configured to receive a fastener to secure the housing to a surface.

In some embodiments, the opening is defined by a height extending orthogonally from the second end of the housing while the cap is removeably coupled with the housing and a width extending perpendicular to the height. The width may be greater than the height. In some embodiments, the light source comprises a white light emitting diode and a red, green, and blue light emitting diode. In some embodiments, the first cavity forms a first aperture in the first flange and the second cavity forms a second aperture in the second flange. In some embodiments, the opening forms an aperture in the cap.

In some embodiments, the housing is a first housing; the cap is a first cap; the opening is a first opening; the light source is a first light source; and the apparatus further comprises a second housing having a third end and a fourth end opposite the third end. The apparatus may further comprise a second light source coupled with the second housing, wherein light from the second light source is configured to be emitted from the second housing at the third end of the second housing. A second cap may be configured to be removeably coupled with the fourth end of the second housing. The second cap may comprise one or more walls that form a second opening. The second cap may also be configured to remain fixed with respect to the second housing while coupled with the second housing. The apparatus may further comprise a cable connecting the first housing with the second housing and electrically coupled with the first light source and the second light source. The second opening may be configured to be aligned parallel with the first opening while the first cap is removeably coupled with the first housing, the second cap is removeably coupled with the second housing, and the cable is fully extended between the first housing and the second housing.

In some embodiments, a method is described. The method may comprise obtaining a light fixture. The light fixture may comprise a housing having a first end and a second end opposite the first end. The light fixture may further comprise a light source coupled with the housing, wherein light from the light source is configured to be emitted from the housing at the first end of the housing. The light fixture may further comprise a cap removeably coupled with the second end of the housing, the cap comprising one or more walls that form an opening and extend beyond the housing while the cap is removeably coupled with the housing. The light fixture may further comprise a first flange coupled with the housing at the second end of the housing. The first flange may comprise one or more walls that form a first cavity. The first cavity may be in the first flange. The light fixture may further comprise a second flange coupled with the housing at the second end of the housing. The second flange may comprise one or more walls that form a second cavity. The second cavity may be in the second flange. The method may further comprise removing the cap from the housing. The method may further comprise mounting the housing to a surface such that the second end of the housing is adjacent the surface.

In some embodiments, the method further comprises hanging the housing from a cable by passing a cord through the opening of the cap and around the cable before removing the cap from the housing. In some embodiments, the second end of the housing comprises a first cylindrical sidewall that forms a recess in the housing configured to receive the cap while the cap is removeably coupled with the housing. The first cylindrical sidewall may comprise a first helical ridge. The cap may comprise a cylindrical base. The cylindrical base may comprise a second cylindrical sidewall configured to fit within the recess in the housing such that the second cylindrical sidewall is completely within the first cylindrical sidewall. The second cylindrical sidewall may comprise a second helical ridge. The second helical ridge may be configured to mate with the first helical ridge while the cap is removeably coupled with the housing. Removing the cap from the housing may comprise unthreading the second helical ridge from the first helical ridge.

In some embodiments, the first cavity and the second cavity are configured to receive one or more types of fasteners and mounting the housing to the surface may comprise positioning a first fastener in the first cavity to secure the first flange to the surface and positioning a second fastener in the second cavity to secure the second flange to the surface. In some embodiments, the housing further comprises a first wire protector configured to restrict a first range of motion of a first cable containing a first wire coupled with the light source, the first wire protector coupled with the housing on an outer wall of the housing. The housing may further comprise a second wire protector configured to restrict a second range of motion of a second cable containing a second wire coupled with the light source, the second wire protector coupled with the housing and positioned opposite the first wire protector. In some embodiments, a wire axis is defined as a straight line from the first wire protector to the second wire protector. In some embodiments, the cap is further configured so that the opening is oriented parallel or perpendicular to the wire axis while the cap is removeably coupled with the housing. In some embodiments, the cap is further configured such that the opening is in a predefined orientation while the cap is removeably coupled with the second end of the housing Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Certain embodiments relate to light fixtures including structures configured for multiple installation techniques. In some embodiments, a light fixture includes a cap with an opening configuring the light fixture to be hung from a support structure and one or more flanges configuring the light fixture to be flush mounted to a surface while the cap is removed from the light fixture. Some light fixtures include a lighting source at one end and a hanging structure at the opposite end. The hanging structure configures the light fixture to be suspended from a support structure, such as a wire or hook. Other light fixtures include one or more mounting structures at the opposite end of the light fixture. The mounting structures configure the light fixture to be mounted flush against a surface. However, a light fixture that provides one feature or the other may limit the potential applications and/or versatility of such a light fixture. To overcome these potential limitations, a light fixture including both features may be used. However, a permanent hanging structure may interfere with the functionality of the mounting structures. Accordingly, a light fixture with a hanging structure configured to be removeably attached to the end of the light fixture can enable the light fixture to be both suspended from a support structure while the hanging structure is attached to the light fixture, and mounted flush against a surface while the hanging structure is removed from the light fixture.

Figure 1:
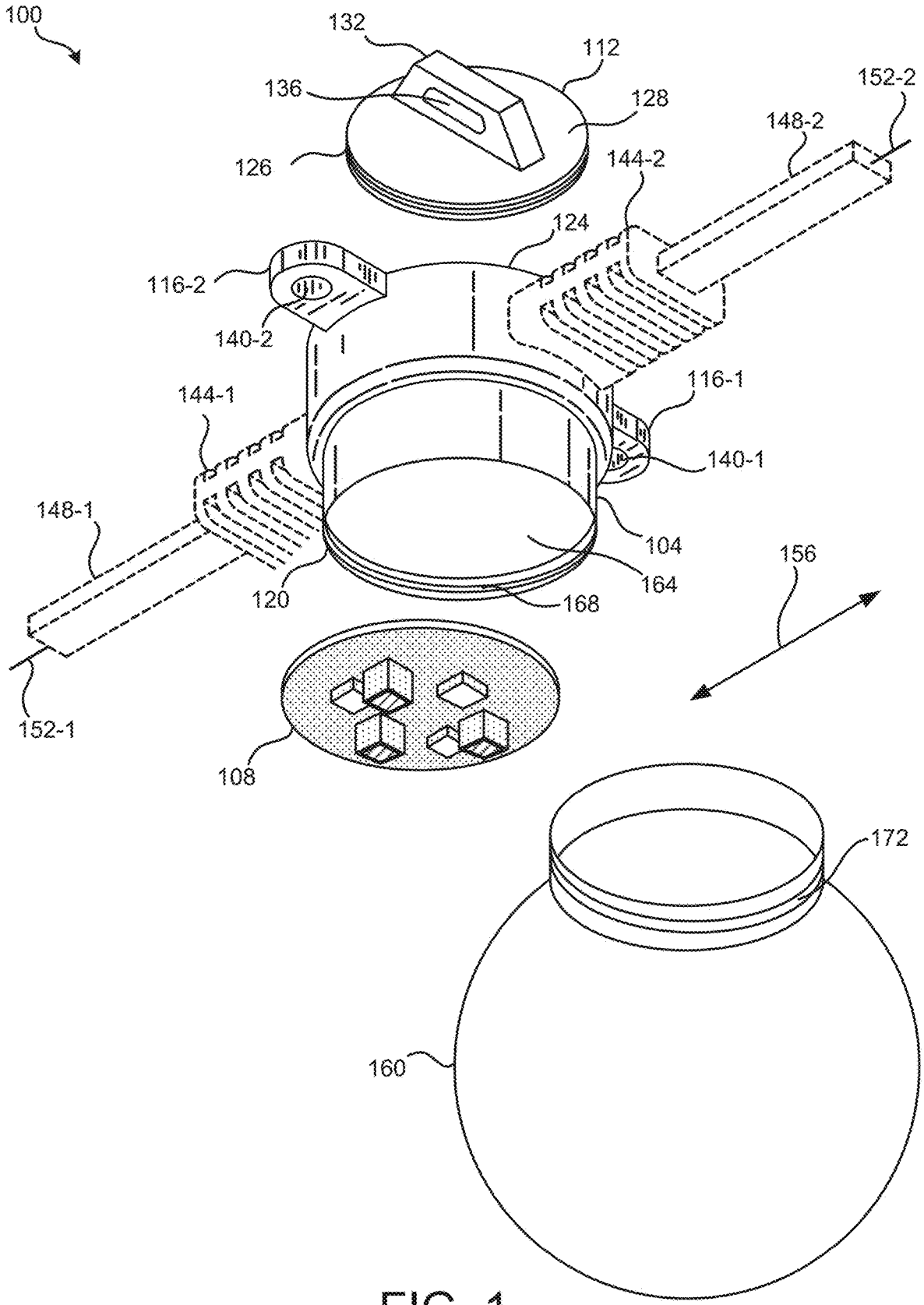
FIG. 1 illustrates a bottom perspective view of an embodiment of a light fixture with a removeably attachable cap and a removeably attachable light enclosure.

FIG. 1 illustrates a bottom perspective view of a light fixture 100. The light fixture 100 comprises a housing 104, a light source 108, a cap 112, and one or more flanges 116. The cap 112 is configured to be removeably attached with the housing 104. The one or more flanges 116 are configured to receive a fastener for securing the housing 104 to a surface. For example, the light fixture 100 can be mounted to a surface by removing the cap 112 and flush mounting the housing 104 to a surface using a fastener (e.g., a screw, a nail, a staple, etc.) in the one or more flanges 116. The cap 112 is configured to receive a fastener for suspending the housing 104 from a support structure. For example, the light fixture 100 can be suspended from a support structure by installing the cap 112 and suspending the housing 104 using a fastener (e.g., a string, a zip-tie, a carabiner, etc.) to couple the cap 112 to the support structure.

The housing 104 is a ridged structure used to enclose the light source 108. The housing 104 has a first end 120 and a second end 124. The light source 108 is coupled with the housing 104. Light from the light source 108 is configured to be emitted from the housing 104 at the first end 120 of the housing 104. The housing 104 is configured, in some embodiments, to shelter the light source 108 from elements. For example, the light fixture 100 is part of an outdoor lighting strand. In this example, the housing 104 may shelter the light source 108 from moisture (e.g., from rain or snow), and/or dust/particulate matter.

The light source 108 emits light. In some embodiments, the light source 108 includes one or more light-emitting diodes (LED). For example, the light source 108 may include one or more white LEDs and/or one or more red, green, and blue (e.g., RGB) LEDs. For example, the light source 108 can be the same, or function in a similar manner, as the light sources described in U.S. patent application Ser. No. 17/534,975, filed on Nov. 24, 2021, entitled, "THREE CHANNEL LED CONTROL FOR COLOR AND WHITE LIGHT PERFORMANCE IN LIGHTING STRANDS," the disclosure of which is incorporated herein by reference in its entirety.

The cap 112 is configured to be removeably coupled with the second end 124 of the housing 104. The cap 112 comprises a sidewall 126, a surface 128, and a ridge 132. The surface 128 is a flat, circular surface bounded by the sidewall 126. The ridge 132 extends from the surface 128. The ridge 132 is defined by a height extending orthogonally above the surface 128. The ridge 132 has a width and a length. The ridge 132 is longer than it is wide.

The ridge 132 comprises one or more walls defining an opening 136. The opening 136 may be used to suspend the light fixture 100 from a support structure while the cap is removeably coupled with the housing 104. For example, a string, a cord, a zip-tie, or other fastener, may be inserted into opening 136 and connected to a support structure such as a cable. The opening is defined by a height extending orthogonally from the second end 124 of the housing 104 while the cap 112 is removeably coupled with the housing 104. The opening 136 is further defined by a width extending perpendicular to the height. In some embodiments, the width of the opening 136 is greater than the height of the opening 136. For example, the opening 136 shown in FIG. 1, is an oval opening in the ridge 132. Using an oval opening in the ridge 132 may allow for easier insertion of various fasteners, such as a flat zip-tie.

In some embodiments, the opening 136 forms an aperture in the cap 112 such that the opening 136 is completely enclosed by the ridge 132. While illustrated as an oval aperture, the aperture formed by the opening 136 may be in the form of other shapes. For example, the aperture formed by the opening 136 may be square, circular, rectangular, ovoid, or other geometric shape. In some embodiments, the ridge 132 may not connect with the surface 128 on both sides of the opening 136. For example, the ridge 132 may form a hook shape such that the opening 136 is only partially enclosed by the ridge 132.

A first flange 116-1 and a second flange 116-2 are coupled with the housing 104 at the second end 124 of the housing 104. The first flange 116-1 and the second flange 116-2 include a bottom surface and a top surface coplanar with the second end 124 of the housing 104. The first flange 116-1 and the second flange 116-2 include a height defined by the distance between the top and bottom surfaces. The top surfaces of the first flange 116-1 and the second flange 116-2 may be flush with the second end 124 of the housing 104. Providing a flush surface between the second end 124 of the housing 104 and the one or more flanges 116 enables the light fixture 100 to be securely mounted to a surface.

The first flange 116-1 and the second flange 116-2 include one or more walls that form cavities 140. For example a first cavity 140-1 is in the first flange 116-1 and a second cavity 140-2 is in the second flange. The first cavity 140-1 and the second cavity 140-2 extend along the height of each flange 116 from the top surface through the bottom surface of the first flange 116-1 and the second flange 116-2 respectively. In some embodiments the first cavity 140-1 forms a first aperture in the first flange 116-1 and the second cavity 140-2 forms a second aperture in the second flange 116-2. For example, as illustrated in FIG. 1, the first cavity 140-1 and the second cavity 140-2 are holes passing through the first flange 116-1 and the second flange 116-2 respectively such that the holes are completely surrounded by the one or more walls of the first flange 116-1 and the one or more walls of the second flange 116-2. In some embodiments, the first cavity 140-1 and the second cavity 140-2 are not completely surrounded by the one or more walls of the first flange 116-1 and the one or more walls of the second flange 116-2. For example, the one or more walls may form hook shaped cavities. The first cavity 140-1 and the second cavity 140-2 are each configured to receive a fastener to secure the housing to a surface. For example, a nail, a screw, a staple, or other fastener may be placed within the first cavity 140-1 or the second cavity 140-2 and driven into a surface to secure the housing to the surface.

The housing 104 further comprises one or more wire protectors 144. A first wire protector 144-1 is coupled with the housing 104 on an outer wall of the housing 104. A second wire protector 144-2 is coupled with the housing 104 opposite the first wire protector 144-1. A wire axis 156 is defined as a straight line from the first wire protector 144-1 to the second wire protector 144-2. In some embodiments, the one or more wire protectors are positioned closer to the second end 124 of the housing 104 than the first end 120 of the housing 104. Positioning the one or more wire protectors 144 closer to the second end 124 of the housing 104 opposite the first end 120 of the housing 104 may provide added stability and improved weight distribution when the light fixture 100 is suspended from a support structure.

The first wire protector 144-1 is configured to restrict a first range of motion of a first cable 148-1. The second wire protector 144-2 is configured to restrict a second range of motion of a second cable 148-2. For example, the first wire protector 144-1 and the second wire protector 144-2 may restrict the first cable 148-1 and the second cable 148-2 from bending within a predefined distance to the housing 104. The first cable 148-1 contains a first wire 152-1 coupled with the light source 108. The second cable 148-2 contains a second wire 152-2 coupled with the light source. The first wire 152-1 and the second wire 152-2 are configured to transmit and receive electricity. For example, the first wire 152-1 and the second wire 152-2 may provide a connection between the light source 108 and a source of power. Alternatively, or additionally, the first wire 152-1 and the second wire 152-2 may provide a connection between the light source 108 and a source of lighting instructions.

The first flange 116-1 is coupled with the housing between the first wire protector 144-1 and the second wire protector 144-2. The second flange 116-2 is coupled with the housing between the first wire protector 144-1 and the second wire protector 144-2 on an opposite side of the housing 104 from the first flange 116-1. Positioning the first flange 116-1 and the second flange 116-2 on opposite sides of the housing 104 may provide more stability and restrict movement of the light fixture 100 when the light fixture 100 is mounted to a surface using fasteners positioned within the first cavity 140-1 and the second cavity 140-2 of the first flange 116-1 and the second flange 116-2 respectively. In some embodiments, a straight line from the first flange 116-1 to the second flange 116-2 is perpendicular to the wire axis 156.

The housing 104 further comprises a light source enclosure 160. The light source enclosure 160 is configured to be removeably coupled with the first end 120 of the housing 104. The light source enclosure 160 provides additional protection to the light source 108 from various elements while the light source enclosure 160 is removeably coupled with the housing 104. The light source enclosure 160 may be further configured to alter the appearance of the light produced by the light source 108. For example, the light source enclosure 160 may be a transparent material configured to disperse bright light from the light source 108. As another example, the light source enclosure 160 may be a partially opaque material configured to softly diffuse the light from light source 108. and the second cable 148-2 may each include The first end 120 of the housing 104 comprises one or more walls defining a cylindrical recess 164. The cylindrical recess 164 is configured to receive the light source enclosure 160 while the light source enclosure 160 is removeably coupled with the housing 104. The cylindrical recess 164 comprises a first threaded cylindrical sidewall 168 on an interior surface of the housing 104. The light source enclosure 160 comprises a second threaded cylindrical sidewall 172 on an exterior surface of the light source enclosure 160. The second threaded cylindrical sidewall 172 is configured to mate with the first threaded cylindrical sidewall 168. For example, the second threaded cylindrical sidewall 172 of the light source enclosure 160 may screw into the first threaded cylindrical sidewall 168 of the cylindrical recess 164, thereby removeably coupling the light source enclosure 160 to the housing 104.

Figure 2:
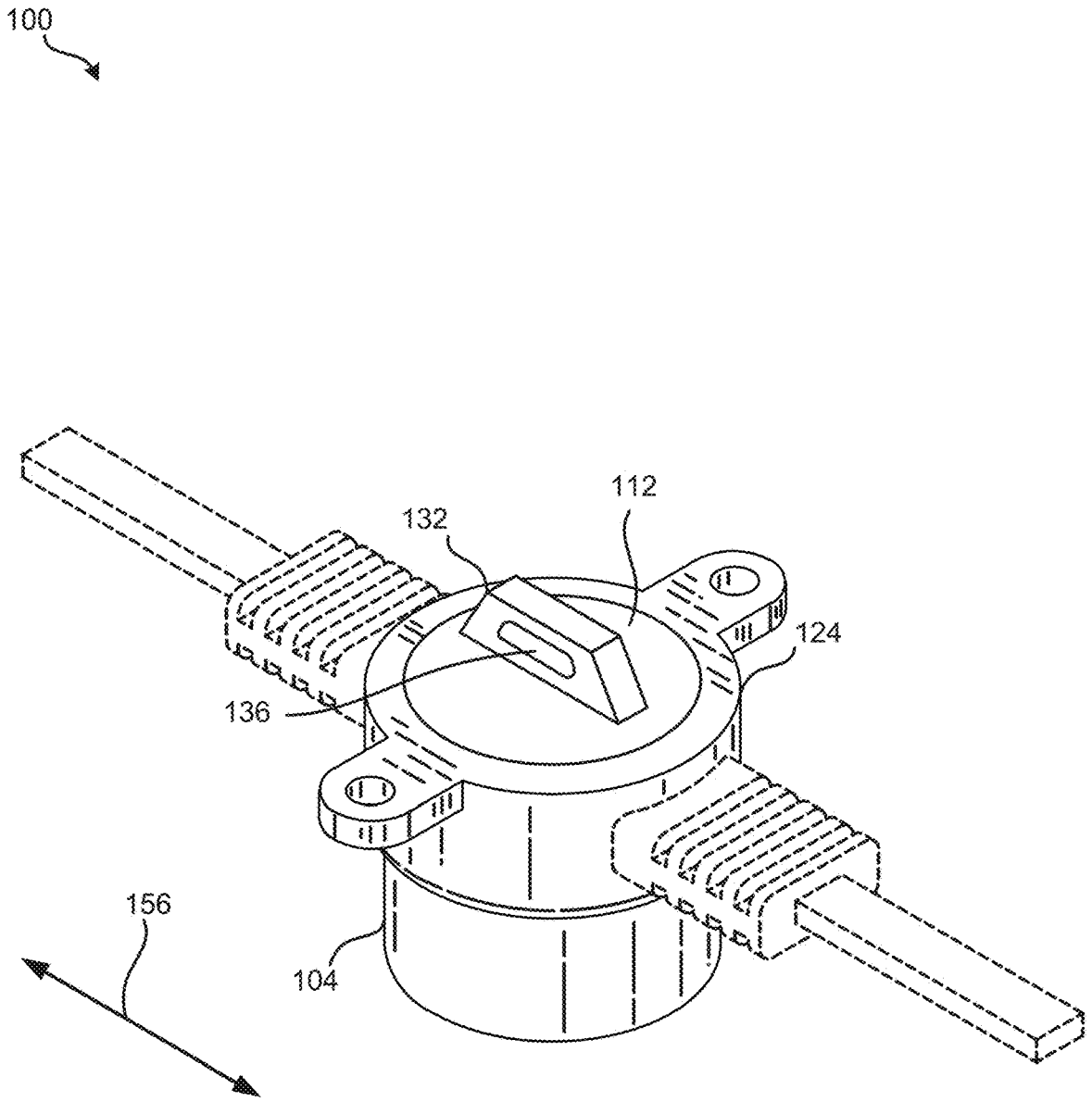
FIG. 2 illustrates a top perspective view of an embodiment of a light fixture with a cap removeably attached to a housing of the light fixture.

FIG. 2 illustrates top perspective view of an embodiment of the light fixture 100. In FIG. 2, the cap 112 is shown removeably coupled with the housing 104. For example, the cap 112 may be secured within a recess in the housing 104, as further described below. The cap 112 and/or the housing 104 may be configured such that the opening 136 of the cap 112 is in a predefined orientation while the cap 112 is removeably coupled with the second end 124 of the housing 104. For example, counterpart structures on the cap 112 and within a recess of the housing 104 may limit the orientation of the cap 112 to a predefined orientation in order to removeably couple the cap 112 with the housing 104, as further described below. In some embodiments, the cap 112 is configured to remain fixed with respect to the housing 104 while the cap 112 is coupled with the housing 104. For example, once the cap 112 is secured to the housing 104, neither the opening 136 nor the ridge 132 move with respect to either the housing 104 or the remainder of the cap 112.

In some embodiments, the cap 112 and/or the housing 104 are configured so that the opening 136 is oriented parallel or perpendicular to the wire axis 156 while the cap 112 is removeably coupled with the housing 104. As shown in FIG. 2, the cap 112 is oriented perpendicular to the wire axis 156, however, other orientations of the cap 112 may be maintained while the cap 112 is removeably coupled with the housing 104, based on specific applications. Configuring the cap 112 and/or the housing 104 so that the opening 136 is perpendicular to the wire axis 156 may improve the ease with which the light fixture 100 is suspended from a support structure, such as a hanging cable. For example, the light fixture 100 may be easily suspended from an existing hanging cable by passing a fastener, such as a zip tie, through opening 136 and connecting the two ends of the fastener around the hanging cable.

Figure 3:
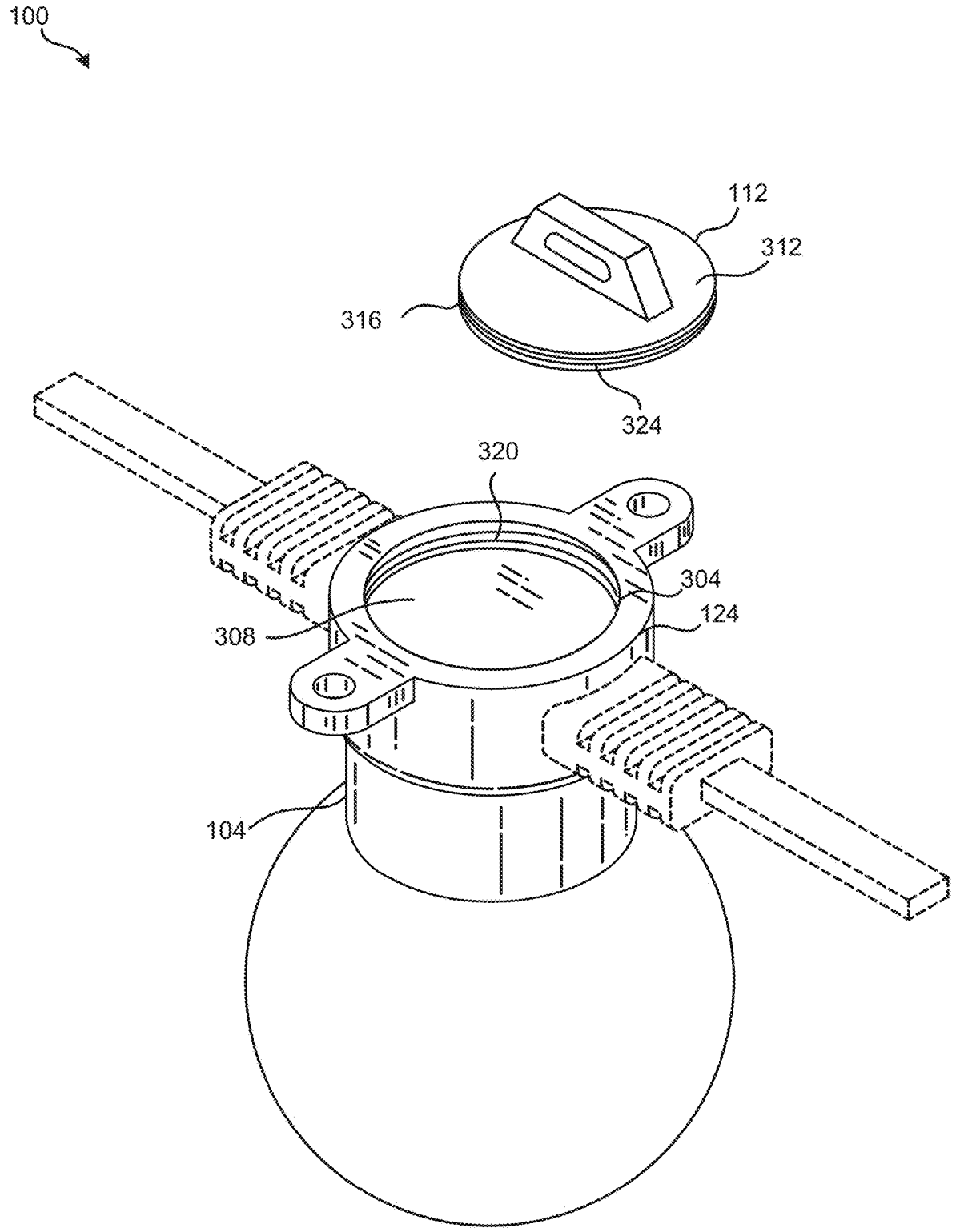
FIG. 3 illustrates a top perspective view of a light fixture with a cap removed from the housing of the light fixture and a light enclosure removeably attached to the housing of the light fixture, in accordance with some embodiments.

FIG. 3 illustrates a top perspective view of the light fixture 100 with the cap 112 uncoupled from the housing 104, in accordance with some embodiments. The second end 124 of the housing 104 comprises a first cylindrical sidewall 304 that forms a recess 308 in the housing 104. The recess 308 is configured to receive the cap 112 while the cap 112 is removeably coupled with the housing 104, as described above. The cap 112 further comprises a cylindrical base 312. The cylindrical base 312 comprises a second cylindrical sidewall 316. In some embodiments, the cylindrical base 312 is configured to fit within the recess 308 of the housing 104 such that the second cylindrical sidewall 316 is completely within the first cylindrical sidewall 304, as illustrated and described below in relation to FIG. 4.

In some embodiments, the first cylindrical sidewall 304 comprises a first helical ridge 320, and the second cylindrical sidewall 316 comprises a second helical ridge 324. The second helical ridge 324 is configured to mate with the first helical ridge 320. For example, the first helical ridge 320 and the second helical ridge 324 may be matching threads that configure the cylindrical base 312 of the cap 112 to be screwed into the recess 308 of the housing 104. While the first cylindrical sidewall 304 and the second cylindrical sidewall 316 are described as having a single helical ridge, the first cylindrical sidewall 304 and the second cylindrical sidewall 316 could include one or more helical ridges of varying lengths configured to mate with each other. For example, the first cylindrical sidewall 304 may include four helical ridges, one in each quadrant of recess 308. In this example, the second cylindrical sidewall 316 may further include four matching helical ridges, one in each quadrant of the second cylindrical sidewall 316.

Figure 4:
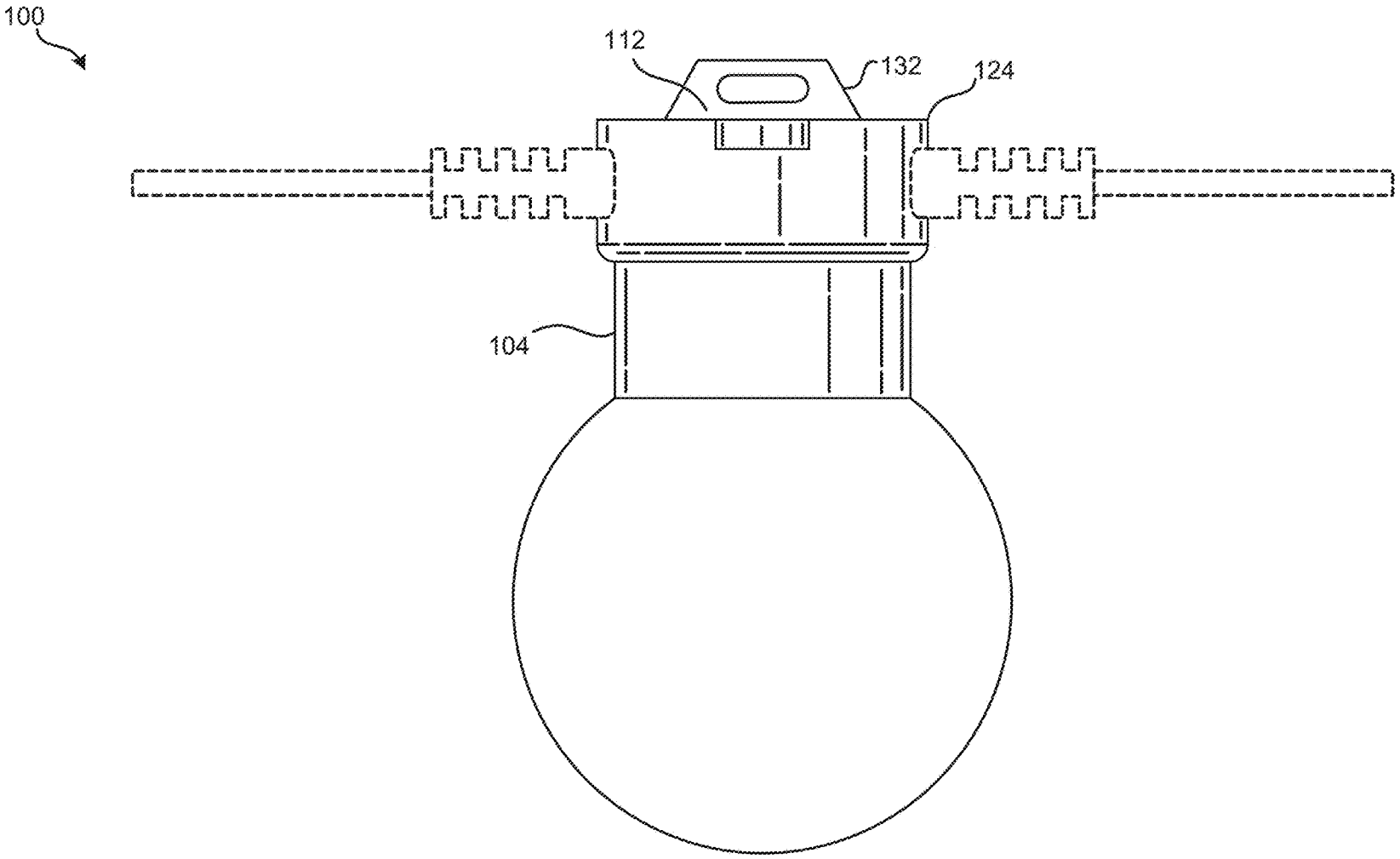
FIG. 4 illustrates a side view of a light fixture with a cap removeably attached to a housing of the light fixture and an opening of the cap in a predefined orientation with respect to the housing of the light fixture, in accordance with some embodiments.

FIG. 4 illustrates a side view of the light fixture, in accordance with some embodiments. In FIG. 4, the cap 112 is shown removeably coupled with the housing 104. As described above, the cylindrical base of cap 112 is configured to fit within the recess in the housing 104 such that the cylindrical sidewall of the cap 112 is completely within the cylindrical sidewall of the housing 104. For example, as illustrated in FIG. 4, the ridge 132 of the cap 112 is the only portion of the cap 112 extending beyond the second end 124 of the housing 104.

Figure 5:
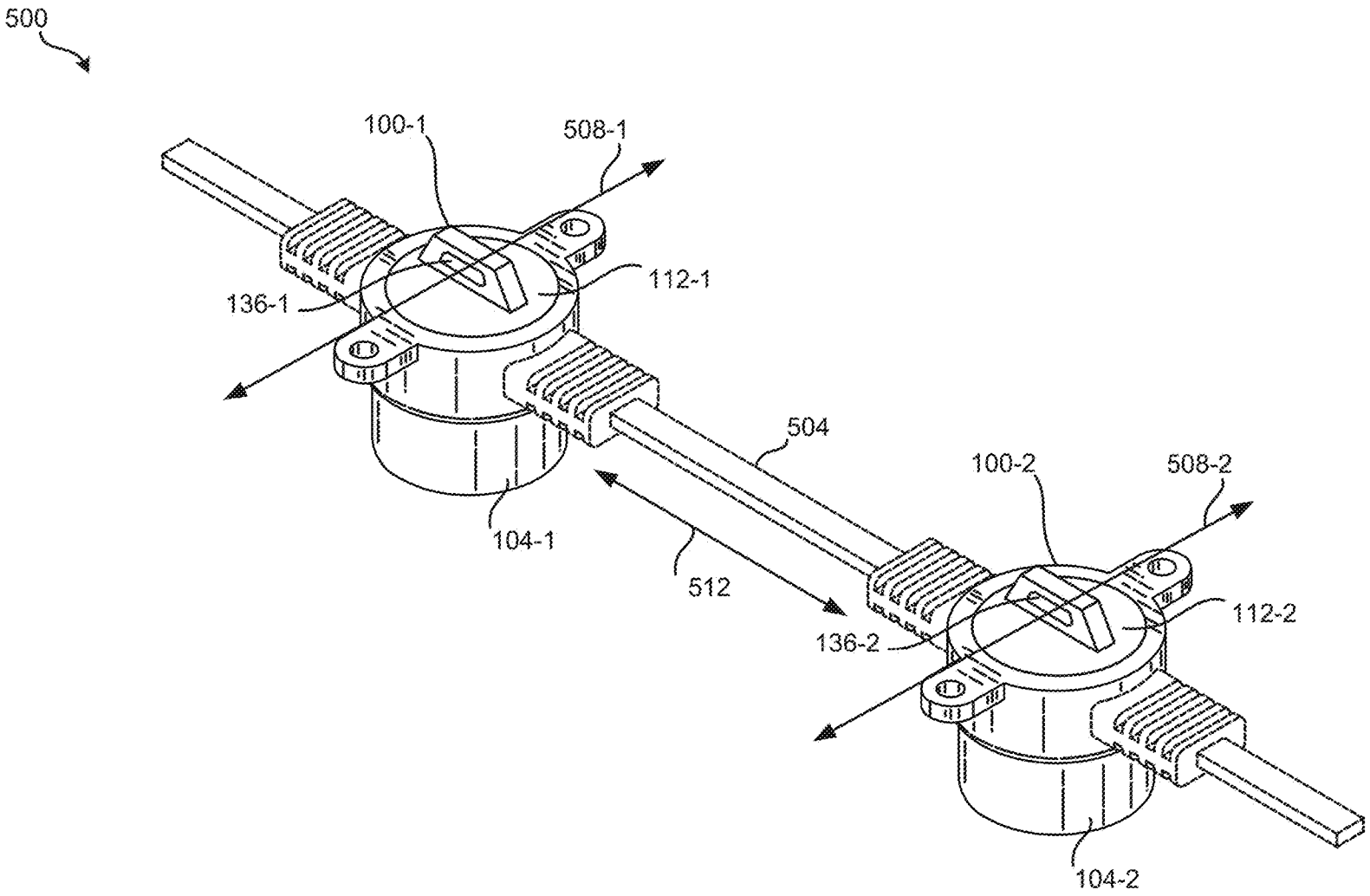
FIG. 5 illustrates a top perspective view of a light strand showing relations of openings in removeably attachable caps of the light strand, in accordance with some embodiments.

FIG. 5 illustrates a top perspective view of a light strand 500, in accordance with some embodiments. Light strand 500 includes first light fixture 100-1 and second light fixture 100-2. While FIG. 5 illustrates the light strand 500 as having only two light fixtures, the light strand 500 could include several light fixtures. In some embodiments, a number of light fixtures 100 of a light strand 500 is equal to or greater than 5, 10, 15, or 20 and equal to or less than 25, 50, or 100. In some embodiments, the number of light fixtures included in the light strand 500 are limited by the amount of power necessary to properly illuminate the light source, such as light source 108 as described above, of each light fixture 100. Each light source of each light fixture 100 may be configured to be individually addressable. For example, each light source may be associated with a unique address and be configured to receive a unique lighting instruction intended for a specific light source based on a unique address included in the lighting instruction.

The first light fixture 100-1 and the second light fixture 100-2 may be the same as light fixture 100 as described above in relation to FIGS. 1-5. For example, each light fixture 100 of the light strand 500 is configured to be mounted to a surface and/or suspended from a support structure, as described above. Each light fixture 100 of the light strand 500 may be coupled in series by a cable. For example, the first cable of the light fixture 100-1 and the second cable of the light fixture 100-2 may be a part of a single cable 504. The cable 504 connects the housing 104-1 of the first light fixture 100-1 with the housing 104-2 of the second light fixture 100-2. In some embodiments, the cable electrically couples a light source of the first light fixture 100-1 with a light source of the second light fixture 100-2.

As described above, the light fixtures 100 include caps 112. In some embodiments, the opening 136-1 of cap 112-1 is configured to be aligned parallel with the opening 136-2 of cap 112-2 while the cap 112-1 is removeably coupled with the housing 104-1, the cap 112-2 is removeably coupled with the housing 104-2, and the cable 504 is fully extended between the housing 104-1 and housing 104-2. For example, as illustrated in FIG. 5, a first opening axis 508-1 through opening 136-1 is parallel with a second opening axis 508-2 through opening 136-2. The opening axes 508 may be perpendicular to a cable axis 512 defined by the cable 504 when the cable 504 is fully extended between the first light fixture 100-1 and the second light fixture 100-2. In some configurations, the cable axis 512 is parallel to the wire axis 156. Orienting each opening axis 508 to be perpendicular with the cable axis 512 may enable the light strand 500 to be more easily suspended from a support structure, such as a catenary cable.

The light strand 500 may be used for decorative and/or a functional lighting purposes. For example, the light strand 500 may be installed in an outdoor space, such from the rafters of a pagoda or similar structure to provide ambient light within the structure. As another example, the light strand 500 may be suspended from a cable hanging between one or more structures to illuminate a walkway or path. In yet another example, the light strand 500 may be mounted to a surface, such as a vertical wall, in various patterns to provide a light show.

The light strand 500 may be one of a plurality of light strands connected in series or parallel with each other. For example, one end of light strand 500 may be connected to a subsequent light strand while the opposite end of light strand 500 is connected to a preceding light strand. Alternatively, one end of the light strand 500 may be connected to a power source and/or a source of lighting instructions while the opposite end of light strand 500 is connected to a subsequent light strand.

Figure 6:
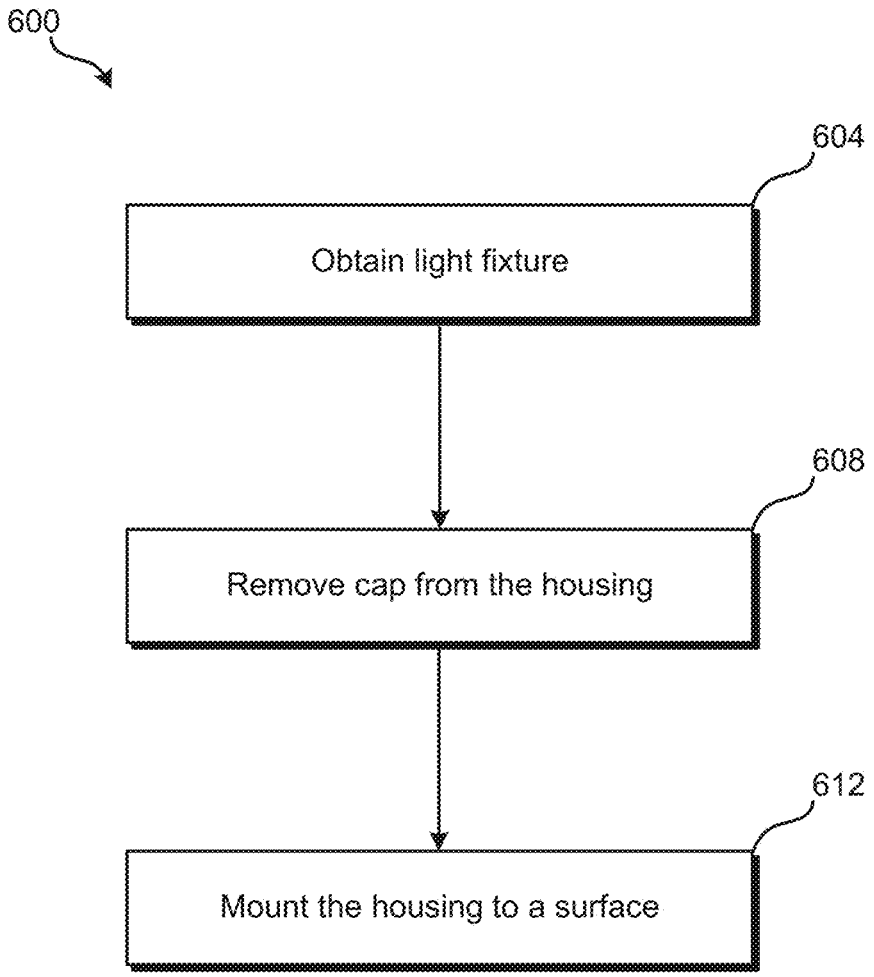
FIG. 6 illustrates an embodiment of a method for mounting a light fixture to a surface.

FIG. 6 illustrates an embodiment of a method 600 for mounting a light fixture to a surface, according to some embodiments. At block 604, the method involves obtaining a light fixture. The light fixture may be the same as light fixture 100 described above in relation to FIGS. 1-5. For example, the light fixture may comprise a housing with a first end and a second end opposite the first end. The light fixture may further include a cap removeably coupled with the second end of the housing. The cap may include one or more walls that form an opening in the cap and extend beyond the housing while the cap is removeably coupled with the housing. The light fixture may further include one or more flanges coupled with the housing at the second end of the housing. The one or more flanges each include one or more walls that from a cavity configured to receive one or more types of fasteners therethrough.

In some embodiments, after block 604 and before block 608, the method 600 may involve hanging the housing of the light fixture from a cable. For example, a cord may be passed through the opening of the cap and around the cable to suspend the light fixture from the cable. The housing may be hung from a support structure in addition to cables. For example, a cord or other fastener may be passed through the opening of the cap and coupled with a hook affixed to a horizontal surface.

At block 608, the method 600 involves removing the cap from the housing. In some embodiments, the second end of the housing includes a first cylindrical sidewall that forms a recess in the housing configured to receive the cap while the cap is removeably coupled with the housing. The cap may also include a cylindrical base comprising a second cylindrical sidewall. The first and second cylindrical sidewalls may respectively include a first helical ridge and a second helical ridge that are configured to mate with each other while the cap is removeably coupled with the housing. In some embodiments, removing the cap from the housing may include unthreading the second helical ridge from the first helical ridge.

At block 612, the method 600 involves mounting the housing to a surface. The housing may be mounted to a surface such as a wall, a ceiling, a rafter, or other surface. The housing is mounted to the surface such that the second end of the housing is adjacent the surface. Mounting the housing to the surface may include positioning a first fastener in the first cavity to secure the first flange to the surface and positioning a second fastener in the second cavity to secure the second flange to the surface. For example, nails may be passed through the first and second cavities from the first end of the housing towards the second end of the housing and driven into the surface to secure the housing to the surface. Other types of fasteners may be used, such as screws, bolts, staples, or other fastener capable of affixing an object to a surface.

Figure 7:
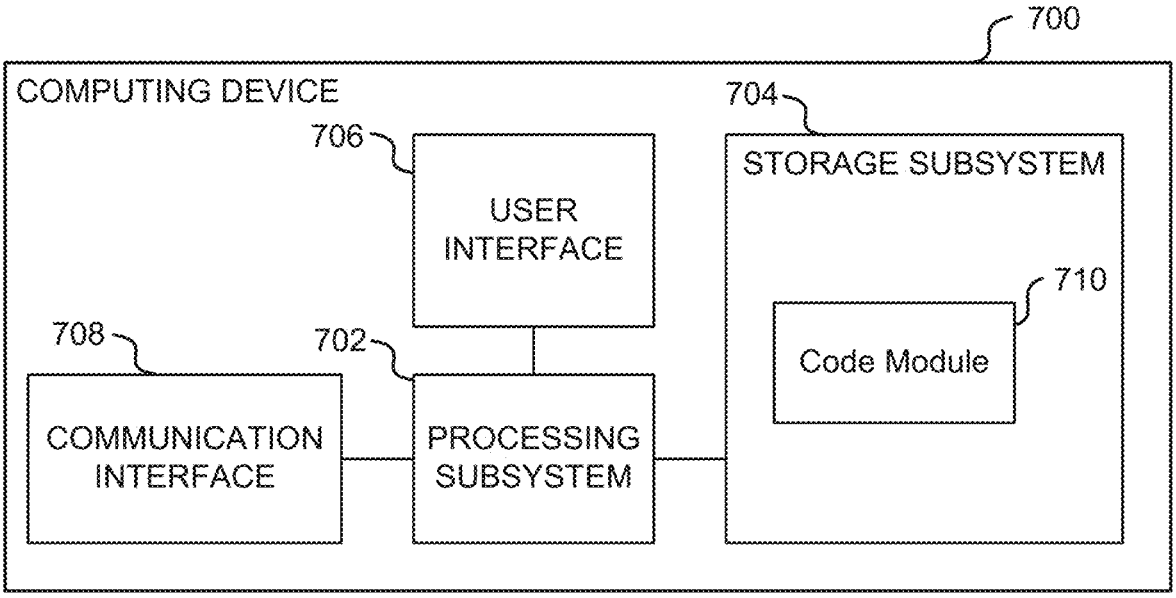
FIG. 7 depicts a block diagram of an embodiment of a computer system.

In some embodiments, a computing device is used to control lights in a light strand. For example, a mobile device, such as a smartphone or table, is used to select brightness, color, and/or sequence of lights of the light strand. FIG. 7 is a simplified block diagram of a computing device 700.

Computing device 700 can implement some or all functions, behaviors, and/or capabilities described above that would use electronic storage or processing, as well as other functions, behaviors, or capabilities not expressly described. Computing device 700 includes a processing subsystem 702, a storage subsystem 704, a user interface 706, and/or a communication interface 708. Computing device 700 can also include other components (not explicitly shown) such as a battery, power controllers, and other components operable to provide various enhanced capabilities. In various embodiments, computing device 700 can be implemented in a desktop or laptop computer, mobile device (e.g., tablet computer, smart phone, mobile phone), wearable device, media device, application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, or electronic units designed to perform a function or combination of functions described above.

Storage subsystem 704 can be implemented using a local storage and/or removable storage medium, e.g., using disk, flash memory (e.g., secure digital card, universal serial bus flash drive), or any other non-transitory storage medium, or a combination of media, and can include volatile and/or non-volatile storage media. Local storage can include random access memory (RAM), including dynamic RAM (DRAM), static RAM (SRAM), or battery backed up RAM. In some embodiments, storage subsystem 704 can store one or more applications and/or operating system programs to be executed by processing subsystem 702, including programs to implement some or all operations described above that would be performed using a computer. For example, storage subsystem 704 can store one or more code modules 710 for implementing one or more method steps described above.

A firmware and/or software implementation may be implemented with modules (e.g., procedures, functions, and so on). A machine-readable medium tangibly embodying instructions may be used in implementing methodologies described herein. Code modules 710 (e.g., instructions stored in memory) may be implemented within a processor or external to the processor. As used herein, the term "memory" refers to a type of long term, short term, volatile, nonvolatile, or other storage medium and is not to be limited to any particular type of memory or number of memories or type of media upon which memory is stored.

Moreover, the term "storage medium" or "storage device" may represent one or more memories for storing data, including read only memory (ROM), RAM, magnetic RAM, core memory, magnetic disk storage mediums, optical storage mediums, flash memory devices and/or other machine-readable mediums for storing information. The term "machine-readable medium" includes, but is not limited to, portable or fixed storage devices, optical storage devices, wireless channels, and/or various other storage mediums capable of storing instruction(s) and/or data.

Furthermore, embodiments may be implemented by hardware, software, scripting languages, firmware, middleware, microcode, hardware description languages, and/or any combination thereof. When implemented in software, firmware, middleware, scripting language, and/or microcode, program code or code segments to perform tasks may be stored in a machine-readable medium such as a storage medium. A code segment (e.g., code module 710) or machine-executable instruction may represent a procedure, a function, a subprogram, a program, a routine, a subroutine, a module, a software package, a script, a class, or a combination of instructions, data structures, and/or program statements. A code segment may be coupled to another code segment or a hardware circuit by passing and/or receiving information, data, arguments, parameters, and/or memory contents. Information, arguments, parameters, data, etc., may be passed, forwarded, or transmitted by suitable means including memory sharing, message passing, token passing, network transmission, etc.

Implementation of the techniques, blocks, steps and means described above may be done in various ways. For example, these techniques, blocks, steps and means may be implemented in hardware, software, or a combination thereof. For a hardware implementation, the processing units may be implemented within one or more ASICs, DSPs, DSPDs, PLDs, FPGAs, processors, controllers, micro-controllers, microprocessors, other electronic units designed to perform the functions described above, and/or a combination thereof.

Each code module 710 may comprise sets of instructions (codes) embodied on a computer-readable medium that directs a processor of a computing device 700 to perform corresponding actions. The instructions may be configured to run in sequential order, in parallel (such as under different processing threads), or in a combination thereof. After loading a code module 710 on a general purpose computer system, the general purpose computer is transformed into a special purpose computer system.

Computer programs incorporating various features described herein (e.g., in one or more code modules 710) may be encoded and stored on various computer readable storage media. Computer readable media encoded with the program code may be packaged with a compatible electronic device, or the program code may be provided separately from electronic devices (e.g., via Internet download or as a separately packaged computer-readable storage medium). Storage subsystem 704 can also store information useful for establishing network connections using the communication interface 708.

User interface 706 can include input devices (e.g., touch pad, touch screen, scroll wheel, click wheel, dial, button, switch, keypad, microphone, etc.), as well as output devices (e.g., video screen, indicator lights, speakers, headphone jacks, virtual- or augmented-reality display, etc.), together with supporting electronics (e.g., digital-to-analog or analog-to-digital converters, signal processors, etc.). A user can operate input devices of user interface 706 to invoke the functionality of computing device 700 and can view and/or hear output from computing device 700 via output devices of user interface 706. For some embodiments, the user interface 706 might not be present (e.g., for a process using an ASIC).

Processing subsystem 702 can be implemented as one or more processors (e.g., integrated circuits, one or more single-core or multi-core microprocessors, microcontrollers, central processing unit, graphics processing unit, etc.). In operation, processing subsystem 702 can control the operation of computing device 700. In some embodiments, processing subsystem 702 can execute a variety of programs in response to program code and can maintain multiple concurrently executing programs or processes. At a given time, some or all of a program code to be executed can reside in processing subsystem 702 and/or in storage media, such as storage subsystem 704. Through programming, processing subsystem 702 can provide various functionality for computing device 700. Processing subsystem 702 can also execute other programs to control other functions of computing device 700, including programs that may be stored in storage subsystem 704.

Communication interface 708 can provide voice and/or data communication capability for computing device 700. In some embodiments, communication interface 708 can include radio frequency (RF) transceiver components for accessing wireless data networks (e.g., Wi-Fi network; 3G, 4G/LTE; etc.), mobile communication technologies, components for short-range wireless communication (e.g., using Bluetooth communication standards, NFC, etc.), other components, or combinations of technologies. In some embodiments, communication interface 708 can provide wired connectivity (e.g., universal serial bus, Ethernet, universal asynchronous receiver/transmitter, etc.) in addition to, or in lieu of, a wireless interface. Communication interface 708 can be implemented using a combination of hardware (e.g., driver circuits, antennas, modulators/demodulators, encoders/decoders, and other analog and/or digital signal processing circuits) and software components. In some embodiments, communication interface 708 can support multiple communication channels concurrently. In some embodiments, the communication interface 708 is not used.

It will be appreciated that computing device 700 is illustrative and that variations and modifications are possible. A computing device can have various functionality not specifically described (e.g., voice communication via cellular telephone networks) and can include components appropriate to such functionality.

Further, while the computing device 700 is described with reference to particular blocks, it is to be understood that these blocks are defined for convenience of description and are not intended to imply a particular physical arrangement of component parts. For example, the processing subsystem 702, the storage subsystem 704, the user interface 706, and/or the communication interface 708 can be in one device or distributed among multiple devices.

Further, the blocks need not correspond to physically distinct components. Blocks can be configured to perform various operations, e.g., by programming a processor or providing appropriate control circuitry, and various blocks might or might not be reconfigurable depending on how an initial configuration is obtained. Embodiments of the present invention can be realized in a variety of apparatus including electronic devices implemented using a combination of circuitry and software. Electronic devices described herein can be implemented using computing device 700.

Various features described herein, e.g., methods, apparatus, computer-readable media and the like, can be realized using a combination of dedicated components, programmable processors, and/or other programmable devices. Processes described herein can be implemented on the same processor or different processors. Where components are described as being configured to perform certain operations, such configuration can be accomplished, e.g., by designing electronic circuits to perform the operation, by programming programmable electronic circuits (such as microprocessors) to perform the operation, or a combination thereof. Further, while the embodiments described above may make reference to specific hardware and software components, those skilled in the art will appreciate that different combinations of hardware and/or software components may also be used and that particular operations described as being implemented in hardware might be implemented in software or vice versa.

Specific details are given in the above description to provide an understanding of the embodiments. However, it is understood that the embodiments may be practiced without these specific details. In some instances, well-known circuits, processes, algorithms, structures, and techniques may be shown without unnecessary detail in order to avoid obscuring the embodiments.

While the principles of the disclosure have been described above in connection with specific apparatus and methods, it is to be understood that this description is made only by way of example and not as limitation on the scope of the disclosure. Embodiments were chosen and described in order to explain the principles of the invention and practical applications to enable others skilled in the art to utilize the invention in various embodiments and with various modifications, as are suited to a particular use contemplated. It will be appreciated that the description is intended to cover modifications and equivalents.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc.

A recitation of "a", "an", or "the" is intended to mean "one or more" unless specifically indicated to the contrary. Patents, patent applications, publications, and descriptions mentioned here are incorporated by reference in their entirety for all purposes. None is admitted to be prior art.

What is claimed is:

1. A light strand comprising:

a first housing having a first end and a second end opposite the first end, wherein:

the second end of the first housing comprises a first cylindrical sidewall that forms a first recess in the first housing, the first cylindrical sidewall comprising a first helical ridge;

a first light source electrically coupled with the first housing, wherein:

light from the first light source is configured to be emitted from the first housing at the first end of the first housing; and the first light source comprises a white light emitting diode and a red, green, and blue light emitting diode;

a first cap configured to be removeably coupled with the second end of the first housing, wherein:

the first cap comprises a first cylindrical base and one or more walls that form a first opening, the first cylindrical base comprising a second cylindrical sidewall configured to fit within the first recess in the first housing, the second cylindrical sidewall comprising a second helical ridge configured to mate with the first helical ridge; and the first cap is configured to remain fixed with respect to the first housing while coupled with the first housing;

a first flange fixedly coupled with the first housing at the second end of the first housing, wherein:

the first flange comprises one or more walls that form a first cavity configured to receive a first fastener to secure the first housing to a surface; and the first cavity is in the first flange;

a second flange fixedly coupled with the first housing at the second end of the first housing, wherein:

the second flange comprises one or more walls that form a second cavity configured to receive a second fastener to secure the first housing to the surface; and the second cavity is in the second flange;

a second housing having a first end and a second end opposite the first end, wherein:

the second end of the second housing comprises a cylindrical sidewall that forms a recess in the second housing;

a second light source electrically coupled with the second housing, wherein:

light from the second light source is configured to be emitted from the second housing at the first end of the second housing; and the first light source and the second light source are configured to be individually addressable;

a second cap configured to be removeably coupled with the second end of the second housing, wherein:

the second cap comprises a second cylindrical base and one or more walls that form a second opening, the second cylindrical base configured to fit within the recess in the second housing; and the second cap is configured to remain fixed with respect to the second housing while coupled with the second housing;

a third flange fixedly coupled with the second housing at the second end of the second housing, wherein:

the third flange comprises one or more walls that form a third cavity configured to receive a third fastener to secure the second housing to the surface; and the third cavity is in the third flange; and a fourth flange fixedly coupled with the second housing at the second end of the second housing, wherein:

the fourth flange comprises one or more walls that form a fourth cavity configured to receive a fourth fastener to secure the second housing to the surface; and the fourth cavity is in the fourth flange a first cable connecting the first housing with the second housing, wherein:

the first opening is configured to be aligned parallel with the second opening while the first cap is removeably coupled with the first housing, the second cap is removeably coupled with the second housing, and the first cable is fully extended between the first housing and the second housing.

2. The light strand of claim 1, wherein:

the first housing further comprises:

a first wire protector configured to restrict a first range of motion of the first cable containing a first wire coupled with the first light source, the first wire protector coupled with the first housing on an outer wall of the first housing; and a second wire protector configured to restrict a second range of motion of a second cable containing a second wire coupled with the first light source, the second wire protector coupled with the first housing and positioned opposite the first wire protector, wherein:

a first wire axis is defined as a straight line from the first wire protector to the second wire protector; and the first cap is further configured so that the first opening is oriented parallel or perpendicular to the first wire axis while the first cap is removeably coupled with the first housing;

the second housing further comprises:

a third wire protector configured to restrict a second range of motion of the first cable containing the first wire coupled with the second light source, the third wire protector coupled with the second housing on an outer wall of the second housing; and a fourth wire protector configured to restrict a first range of motion of a third cable containing a third wire coupled with the second light source, the fourth wire protector coupled with the second housing and positioned opposite the third wire protector, wherein:

a second wire axis is defined as a straight line from the third wire protector to the fourth wire protector; and the second cap is further configured so that the second opening is oriented parallel or perpendicular to the second wire axis while the second cap is removeably coupled with the second housing;

the first opening is defined by a first height extending orthogonally from the second end of the first housing while the first cap is removeably coupled with the first housing and a first width extending perpendicular to the first height;

the second opening is defined by a second height extending orthogonally from the second end of the second housing while the second cap is removeably coupled with the second housing and a second width extending perpendicular to the second height;

the first width is greater than the first height; and the second width is greater than the second height.

3. An apparatus comprising:

a housing having a first end and a second end opposite the first end;

a light source electrically coupled with the housing, wherein light from the light source is configured to be emitted from the housing at the first end of the housing;

a cap configured to be removeably coupled with the second end of the housing, wherein:

the cap comprises one or more walls that form an opening; and the cap is configured to remain fixed with respect to the housing while coupled with the housing;

a first flange fixedly coupled with the housing at the second end of the housing, wherein:

the first flange comprises one or more walls that form a first cavity; and the first cavity is in the first flange; and a second flange fixedly coupled with the housing at the second end of the housing, wherein:

the second flange comprises one or more walls that form a second cavity; and the second cavity is in the second flange.

4. The apparatus of claim 3, wherein:

the second end of the housing comprises a first cylindrical sidewall that forms a recess in the housing configured to receive the cap while the cap is removeably coupled with the housing, the first cylindrical sidewall comprising a first helical ridge;

the cap further comprises a cylindrical base, the cylindrical base comprising a second cylindrical sidewall and being configured to fit within the recess in the housing such that the second cylindrical sidewall is completely within the first cylindrical sidewall, the second cylindrical sidewall comprising a second helical ridge; and the second helical ridge is configured to mate with the first helical ridge.

5. The apparatus of claim 3, wherein the cap is further configured such that the opening is in a predefined orientation, while the cap is removeably coupled with the second end of the housing.

6. The apparatus of claim 3, wherein the housing further comprises:

a first wire protector configured to restrict a first range of motion of a first cable containing a first wire coupled with the light source, the first wire protector coupled with the housing on an outer wall of the housing; and a second wire protector configured to restrict a second range of motion of a second cable containing a second wire coupled with the light source, the second wire protector coupled with the housing and positioned opposite the first wire protector, wherein:

a wire axis is defined as a straight line from the first wire protector to the second wire protector; and the cap is further configured so that the opening is oriented parallel or perpendicular to the wire axis while the cap is removeably coupled with the housing.

7. The apparatus of claim 6, wherein:

the first flange is fixedly coupled with the housing between the first wire protector and the second wire protector;

the second flange is fixedly coupled with the housing between the first wire protector and the second wire protector; and the second flange is fixedly coupled with the housing opposite the first flange.

8. The apparatus of claim 7, wherein a straight line from the first flange to the second flange is perpendicular to the wire axis.

9. The apparatus of claim 3, wherein the first cavity and the second cavity are configured to receive a fastener to secure the housing to a surface.

10. The apparatus of claim 3, wherein:

the opening is defined by a height extending orthogonally from the second end of the housing while the cap is removeably coupled with the housing and a width extending perpendicular to the height, and the width is greater than the height.

11. The apparatus of claim 3, wherein the light source comprises:

a white light emitting diode; and a red, green, and blue light emitting diode.

12. The apparatus of claim 3, wherein:

the first cavity forms a first aperture in the first flange; and the second cavity forms a second aperture in the second flange.

13. The apparatus of claim 3, wherein the opening forms an aperture in the cap and the apparatus further comprises a light enclosure configured to be removably coupled with the first end of the housing.

14. The apparatus of claim 3, wherein:

the housing is a first housing;

the cap is a first cap;

the opening is a first opening;

the light source is a first light source;

and the apparatus further comprises:

a second housing having a third end and a fourth end opposite the third end;

a second light source electrically coupled with the second housing, wherein light from the second light source is configured to be emitted from the second housing at the third end of the second housing a second cap configured to be removeably coupled with the fourth end of the second housing, wherein:

the second cap comprises one or more walls that form a second opening; and the second cap is configured to remain fixed with respect to the second housing while coupled with the second housing; and a cable connecting the first housing with the second housing and electrically coupled with the first light source and the second light source, wherein:

the second opening is configured to be aligned parallel with the first opening while the first cap is removeably coupled with the first housing, the second cap is removeably coupled with the second housing, and the cable is fully extended between the first housing and the second housing.

15. A method comprising:

obtaining a light fixture, the light fixture comprising:

a housing having a first end and a second end opposite the first end;

a light source coupled with the housing, wherein light from the light source is configured to be emitted from the housing at the first end of the housing;

a cap removeably coupled with the second end of the housing, the cap comprising one or more walls that form an opening and extend beyond the housing while the cap is removeably coupled with the housing;

a first flange coupled with the housing at the second end of the housing, wherein:

the first flange comprises one or more walls that form a first cavity; and the first cavity is in the first flange; and a second flange coupled with the housing at the second end of the housing, wherein:

the second flange comprises one or more walls that form a second cavity; and the second cavity is in the second flange;

removing the cap from the housing; and mounting the housing to a surface such that the second end of the housing is adjacent the surface.

16. The method of claim 15, further comprising hanging the housing from a cable by passing a cord through the opening of the cap and around the cable before removing the cap from the housing.

17. The method of claim 15, wherein:

the second end of the housing comprises a first cylindrical sidewall that forms a recess in the housing configured to receive the cap while the cap is removeably coupled with the housing, the first cylindrical sidewall comprising a first helical ridge;

the cap comprises a cylindrical base, the cylindrical base comprising a second cylindrical sidewall and being configured to fit within the recess in the housing such that the second cylindrical sidewall is completely within the first cylindrical sidewall, the second cylindrical sidewall comprising a second helical ridge;

the second helical ridge is configured to mate with the first helical ridge while the cap is removeably coupled with the housing; and removing the cap from the housing comprises unthreading the second helical ridge from the first helical ridge.

18. The method of claim 15, wherein:

the first cavity and the second cavity are configured to receive one or more types of fasteners; and mounting the housing to the surface comprises:

positioning a first fastener in the first cavity to secure the first flange to the surface; and positioning a second fastener in the second cavity to secure the second flange to the surface.

19. The method of claim 15, wherein the housing comprises:

a first wire protector configured to restrict a first range of motion of a first cable containing a first wire coupled with the light source, the first wire protector coupled with the housing on an outer wall of the housing; and a second wire protector configured to restrict a second range of motion of a second cable containing a second wire coupled with the light source, the second wire protector coupled with the housing and positioned opposite the first wire protector, wherein:

a wire axis is defined as a straight line from the first wire protector to the second wire protector; and the cap is further configured so that the opening is oriented parallel or perpendicular to the wire axis while the cap is removeably coupled with the housing.

20. The method of claim 15, wherein the cap is further configured such that the opening is in a predefined orientation while the cap is removeably coupled with the second end of the housing.

* * * * *